United States Patent [19]

Stevens

[11] Patent Number: 4,964,569

[45] Date of Patent: Oct. 23, 1990

[54] WARM AIR SPRAY SYSTEM

[75] Inventor: Clarence L. Stevens, Marietta, Ga.

[73] Assignee: SPR International, Inc., Marietta, Ga.

[21] Appl. No.: 299,509

[22] Filed: Jan. 23, 1989

[51] Int. Cl.[5] ..... B05B 7/16

[52] U.S. Cl. ..... 239/13; 239/124; 239/135; 239/397.5

[58] Field of Search ..... 239/124, 135, 397.5, 239/13; 427/422

[56] References Cited

U.S. PATENT DOCUMENTS

| | | | |
|---|---|---|---|
| 2,148,986 | 2/1939 | Hoyt . | |
| 2,942,787 | 6/1960 | Bok et al. | 239/127 |
| 2,980,786 | 4/1961 | Chilton . | |
| 3,219,027 | 11/1965 | Roche | 239/135 |
| 3,336,463 | 8/1967 | Johnson | 239/135 |
| 3,776,462 | 12/1973 | Payne, Jr. | 239/135 |
| 4,034,916 | 7/1977 | Forsberg | 239/373 |
| 4,602,680 | 7/1986 | Bradford | 165/111 |
| 4,667,084 | 5/1987 | Regge | 239/135 |
| 4,723,710 | 2/1988 | Lucore, II | 239/124 |

*Primary Examiner*—Andres Kashnikow
*Assistant Examiner*—Karen B. Merritt
*Attorney, Agent, or Firm*—Edwin E. Greigg

[57] ABSTRACT

An air spray system including an air spray device including an oil-less piston type air compressor for heating an air output of the compressor, an air supply line, an air return line, an air spray device and control valves which can be adjusted to supply a proper amount of air to the spray device. The air supply and air return lines are insulated in a flexible type insulation so that the air flow in the supply and return lines will remain warm to prevent any formation of condensation.

5 Claims, 1 Drawing Sheet

WARM AIR SPRAY SYSTEM

FIELD OF THE INVENTION

This invention is directed to a warm air spray system, and more particularly to a warm air spray system which prevents the formation of condensation which poses problems in spray painting and forced air spray devices and systems for other uses.

DESCRIPTION OF THE RELATED ART

Heretofore, spray devices and systems have utilized heated air under pressure for delivery of the spray. Such devices have been set forth in U.S Pat. Nos. 2,980,786; 3,336,463 and 4,602,680. These devices have certain drawbacks such as requiring the heating of the substance to be sprayed, as well as other features which do not entirely prevent condensation from forming and mixing with the air used in the sprayer device. It is well known that condensation is a major problem when paint or other substances are used with a spray device employing warm air for delivery of the spray.

It is therfore an object of this invention to provide a heated air system to be used in a spray system which may be connected to any desired spray device which prevents the formation of condensation within the warm air supply.

Another object is to provide a system which heats air in which any moisture in the fresh air is retained within the heated air without forming condensation.

Yet another object is to provide a warm air spray system which permits adjustment of the warm air supply without production of condensation.

DETAILED DESCRIPTION

Figure 1:
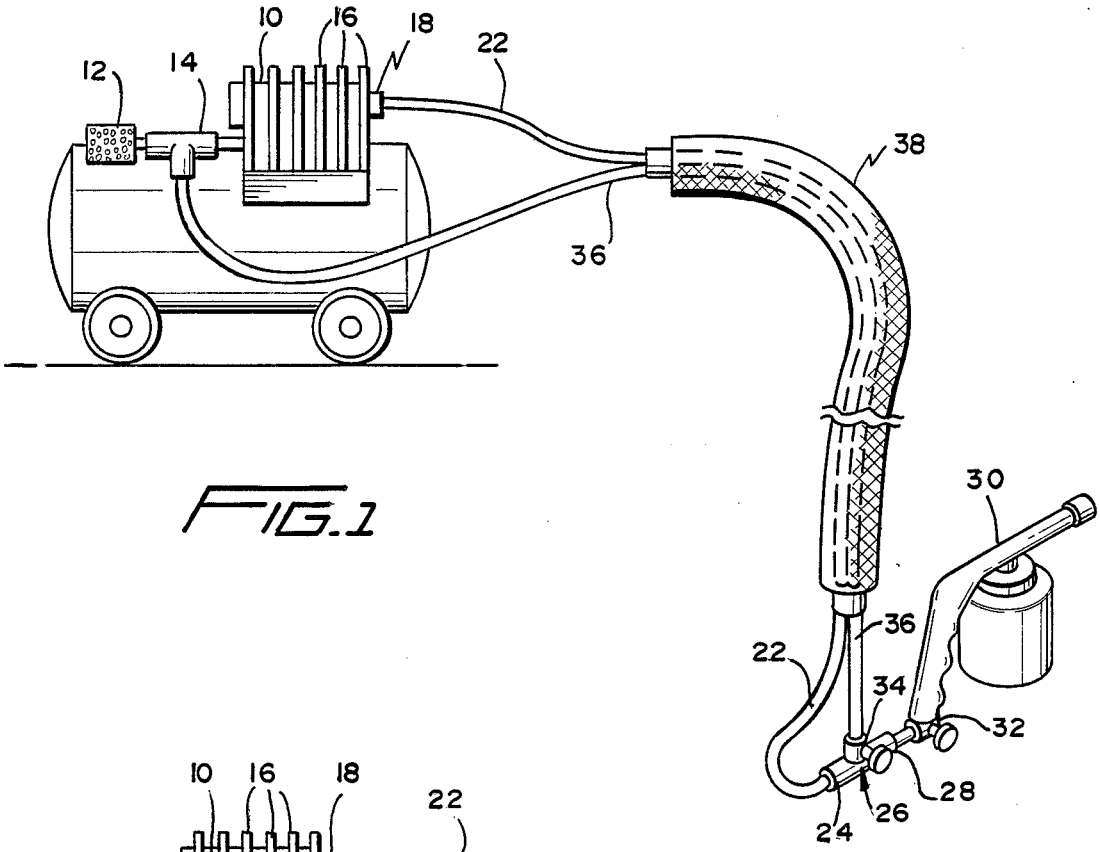
FIG. 1 illustrates a compressor and warm air delivery system for supplying warm air to an air controlled spray device.

Now referring to the drawing, there is shown in FIG. 1 an oil-free piston type air compressor 10 which has an air intake filter 12 connected to the air compressor via a tee connection 14. The compressed air is heated by compressing the air and is then directed from the compressor by an outlet fitting 18 to which an air supply line or hose 22 is connected. Air cooling fins are shown at 16. The air supply hose 22 is connected at its opposite end to one end 24 of a second tee fitting 26 by any suitable connector. Any suitable forced air spray means 30 is connected to the opposite end 28 of the tee 26 via a control valve 32. An air control valve 34 is connected to the middle tee connection to which one end of an air return line 36 is connected. The opposite end of the air return line 36 is connected with the middle connection of the tee connection 14 in the air inlet line. The air supply line 22 and the air return line 36 are covered with a flexible type insulation over the length thereof to retain as much of the heat as possible within the supply and return lines. The supply and return lines may be covered by the same insulation 38 over a majority of their lengths so that the heat in one line may add to the heat in the other line and to provide only one composite line to and from the air spray device. From the separation point of the supply line and return line, the separate lines may be insulated separately in order to permit connection of the two lines to the compressor.

Figure 2:
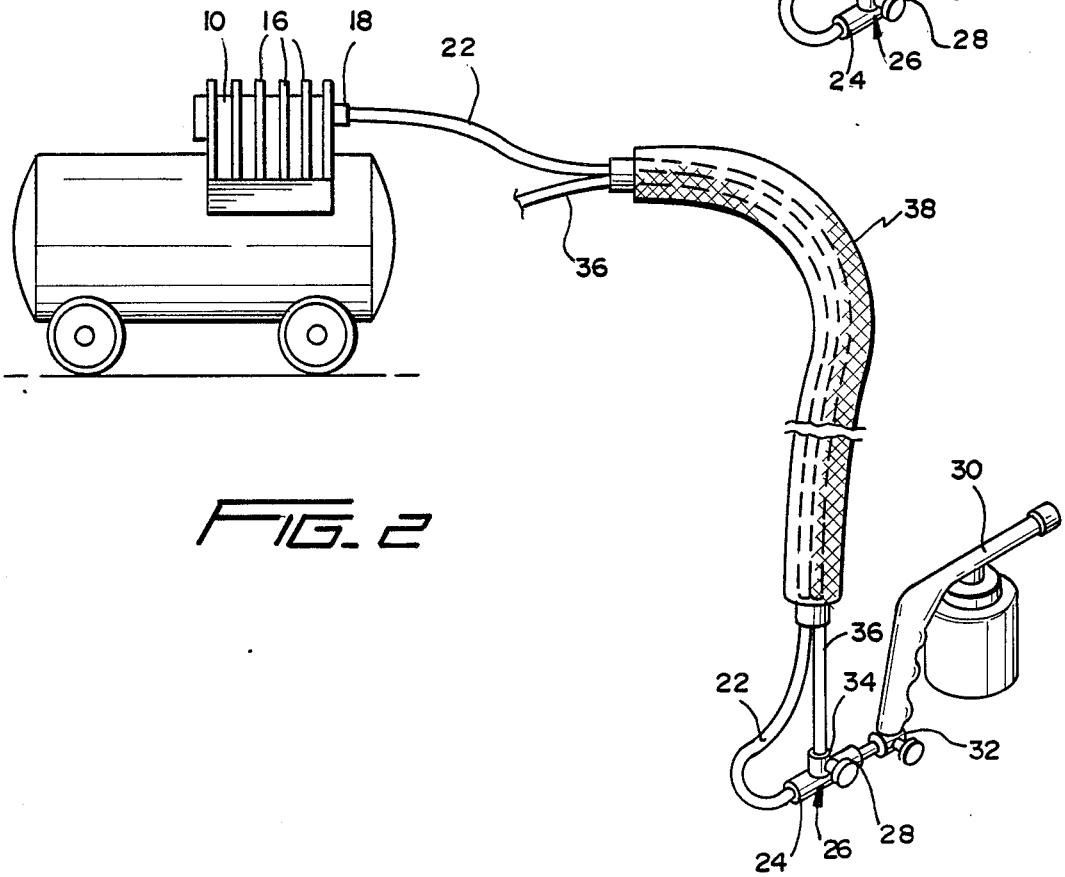
FIG. 2 is a modification of FIG. 1.

FIG. 2 illustrates an air compressor-sprayer as shown in FIG. 1, except that there is no tee connection for the air inlet to the compressor. The return line 36 is cut off at the end toward the compressor so that the air exhausts to the atmosphere.

In operation, the lines and sprayer are connected into the system. With the compressor inoperative, the control valve to the spray device is closed, the valve to the air return line is opened to full, then the compressor is activated. The air is circulated via the supply line and the return line until the air and lines are warmer than the ambient temperature. Once the air supply and return lines reach substantially the same temperature, the system is ready to utilize the warm air for delivery of the spray. The control valve to the return line may be adjusted toward closed and the control valve to the spray device is actuated to full open. The air pressure for the spray device is then controlled by the opening or closing of the valve in the return line. The more the valve in the return line is closed, the greater the flow of air to the spray device. If necessary, the control valve to the spray device may also be used in adjusting the air to the spray device. It is obvious that either or both of the control valves may be adjusted to adjust the air flow to the spray device. Obviously, any closure of the return control valve will restrict the flow of the return air back to the compressor shown in FIG. 1, or toward the compressor as shown in FIG. 2, which results in more air being directed to the spray device. The air not required by the spray device is directed back to the compressor by control of the valve in the return line.

Since the air is warmed at the compressor and the air is retained in a warm state during supply and return by the insulation of the supply and return lines, the air will be supplied to the spray device without any condensation developing. Any moisture in the inlet air will be heated with the air and will be retained in the warm air without condensate forming in the supply and return lines.

The system of the present invention may be used for any type of air controlled spray device, either fixed or portable, to prevent the formation of condensation which is prevalent in prior art spray systems.

The foregoing is a preferred exemplary embodiment of the invention, it being understood that other variants and embodiments thereof are possible within the spirit and scope of the invention, the latter being defined by the appended claims.

I claim:

1. A warm air-spray system which comprises:

an oil-less piston-type air compressor which heats air supplied thereto via an inlet end and conducts the warm air to an outlet, an air-spray device, a first control valve which is connected at a first end to said air-spray device which controls warm air flow to said air-spray device, a second air control valve which is connected at a first connection to a second end of said first air control valve which controls air flow to said first air control valve, an air supply line connected at a first end to said outlet of said air compressor and at a second end to a second connection of said second air control valve for supplying a warm air flow to said air-spray device via said second and first air control valves, a warm air return line connected at one end to a third connection of said second air control valve to return unneeded warm air back toward said air compressor, said air supply line and said air return line are secured together over most of their length juxtaposed each other, and means for insulating said air supply line and said air return line over substantially their entire length.

2. A warm air-spray system as set forth in claim 1 which includes:

a filter which filters ambient air before said ambient air enters said inlet to said air compressor; and said return line is secured to a fitting between said filter and said air compressor to supply any returned warm air to said air compressor.

3. A method of supplying warm air to an air-spray device which comprises:

producing a supply of heated compressed air via an air compressor, maintaining said supply of heated compressed air, delivering a flow of said heated supply of compressed air from said air compressor via a supply line directly to said air-spray device, controlling a flow of said heated supply of air to said air-spray device by a control means, controlling a flow of said heated supply of air to said control means, and controlling and directing any excess heated supply of compressed air delivered to said air-spray device back to said air compressor via a return line.

4. A method as set forth in claim 3 which comprises:

insulating said supply and return lines to prevent loss of heat during delivery and return of said heated compressed air to and from said air-spray device and from and to said air compressor.

5. A method as set forth in claim 4 which comprises:

prior to admitting controlled compressed air to said air-spray device during a warm-up period, circulating air through said supply and return lines until said supply and return lines are warmed to a warmth greater than at ambient temperature.

* * * * *